US008302953B2

(12) United States Patent
Togashi et al.

(10) Patent No.: US 8,302,953 B2
(45) Date of Patent: Nov. 6, 2012

(54) IMAGE FORMING APPARATUS

(75) Inventors: Toshifumi Togashi, Zama (JP); Manabu Nonaka, Chigasaki (JP); Hideto Higaki, Yokohama (JP); Tsugunao Toyooka, Sagamihara (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 12/805,911

(22) Filed: Aug. 24, 2010

(65) Prior Publication Data

US 2011/0062655 A1 Mar. 17, 2011

(30) Foreign Application Priority Data

Sep. 17, 2009 (JP) ..... 2009-216011

(51) Int. Cl.
*B65H 3/16* (2006.01)

(52) U.S. Cl. ..... 271/18.2; 271/18.1; 271/10.14

(58) Field of Classification Search ..... 271/193, 271/18.1, 18.2, 14, 10.14
See application file for complete search history.

(56) References Cited

U.S. PATENT DOCUMENTS 2,820,632 A * 1/1958 Fowler ..... 271/18.2
5,219,154 A * 6/1993 Fukube et al. ..... 271/18.2
5,232,213 A * 8/1993 Parsons et al. ..... 271/95
5,316,282 A * 5/1994 Fukube et al. ..... 271/10.07
5,322,269 A * 6/1994 Fukube et al. ..... 271/18.1
5,593,151 A * 1/1997 Mashtare et al. ..... 271/193
7,445,206 B2 * 11/2008 Lee ..... 271/117

FOREIGN PATENT DOCUMENTS

JP 04-350031 12/1992
JP 11184171 A * 7/1999
JP 3159727 2/2001
JP 3220541 8/2001
JP 2003-237958 8/2003
JP 3927833 3/2007
JP 2009-023813 2/2009

OTHER PUBLICATIONS

Abstract of JP 04-251041 published on Sep. 7, 1992.
Abstract of JP 06-199437 published on Jul. 19, 1994.
Abstract of JP 2003-237960 published on Aug. 27, 2003.

* cited by examiner

*Primary Examiner* — Michael McCullough
*Assistant Examiner* — Howard Sanders
(74) *Attorney, Agent, or Firm* — Harness, Dickey & Pierce, P.L.C.

(57) ABSTRACT

A sheet separating and feeding unit incorporable in an image forming apparatus includes an image forming device, a sheet container, a sheet feeding unit including an endless, dielectric belt and an electric potential pattern forming unit, a belt supporting mechanism including a first supporting roller and a second supporting roller, and a moving unit. The first supporting roller rotates to rotatably move the second supporting roller between a sheet attracting position and a sheet feeding position so that the flat portion of the dielectric belt moves between the sheet contact position and the sheet pick-up position.

6 Claims, 7 Drawing Sheets

IMAGE FORMING APPARATUS

CROSS-REFERENCE TO RELATED APPLICATIONS

The present patent application claims priority pursuant to 35 U.S.C. §119 from Japanese Patent Application No. 2009-216011, filed on Sep. 17, 2009 in the Japan Patent Office, which is hereby incorporated by reference herein in its entirety.

BACKGROUND OF THE INVENTION

1. Field of the Invention

Exemplary embodiments of the present patent application relate to an image forming apparatus that incorporates a sheet feeding unit in which an uppermost sheet placed on a sheet stack is attracted to the surface of a dielectric belt by the action of an electric field generated by electric potential patterns formed on the surface of the dielectric belt and fed in a sheet feeding direction as the dielectric belt rotates.

2. Discussion of the Related Art

Related-art image forming apparatuses, such as copiers, facsimile machines, printers, or multifunction printers having at least one of copying, printing, scanning, and facsimile functions, typically form an image on a sheet of recording media according to image data. Thus, for example, a sheet feeding unit feeds a plurality of sheets one by one toward an image forming device. The image forming device forms an image on a sheet fed from the sheet feeding device.

The sheet feeding device incorporated in such related-art electrophotographic or inkjet image forming apparatuses often use a friction feed method by including a friction member to separate an uppermost sheet from other sheets of the sheet stack loaded in a sheet cassette. Specifically, the friction member, made of rubber having a high friction coefficient, pressingly contacts the uppermost sheet to separate the uppermost sheet from other sheets and conveys it as appropriate. One problem with such an arrangement is that the high friction coefficient of the friction member, which is necessary to feed the sheets to the image forming device in a stable manner, may deteriorate over time or according to environmental conditions, degrading feeding performance of the sheet feeding unit.

Further, when the image forming apparatus is used as a printer, it handles various types of recording media, such as plain paper, coated paper, and label paper. With recording media having a substantially small friction coefficient, sheets providing friction that varies depending on temperature, or sheets absorbing moisture and adhering to each other, the friction member of the sheet supplier may not separate the uppermost sheet from other sheets properly.

Further still, with recording media such as adhesive labels, the surface portion of the sheet can be easily separated from the underlying base layer of the sheet by the frictional force exerted between the pickup member and the recording medium, hindering reliable pick-up of the recording medium by the friction feeding method.

To address the above-described drawback, the image forming apparatus can employ an electrostatic sheet feed method in which recording media are electrically attracted to the surface of a dielectric belt by the action of electric field generated by electric potential patterns formed on the surface of the dielectric belt and separated from a stack of recording media one by one as the dielectric belt rotates.

In the electrostatic sheet feed method, the electric potential patterns formed on the surface of the dielectric belt generate a non-uniform electric field at an interface between the surface of the dielectric belt and the upper surface of the sheet stack. The non-uniform electric field exerts a force of attraction in a normal direction of the interface based on the Maxwell stress to convey the uppermost sheet placed atop the sheet stack as the dielectric belt rotates while attracting the uppermost sheet to the surface of the dielectric belt.

As an example of the electrophotographic image forming apparatus that employs such an electrostatic sheet feed method, Japanese Patent Application Publication No. 2003-237958 (JP-2003-237958-A1) has been proposed.

With the electrophotographic sheet feed method, if the uppermost sheet is picked up from the sheet stack on contacting the dielectric belt, several subsequent upper sheets including a second uppermost sheet are also sometimes picked up together with the uppermost sheet by the dielectric belt by action of an electric field generated by potential patterns formed on the dielectric belt. Therefore, the dielectric belt remains contacted with the sheet stack for a predetermined period of time from the moment the dielectric belt contacts the sheet stack before separating from the sheet stack, thus decreasing the action of the electric field on the second uppermost sheet, which in turn enables the uppermost sheet to be separated from the sheet stack to contact the dielectric belt. However, it is known that, for various reasons, the force of attraction is generated at the contact portion between the uppermost sheet and the second uppermost sheet even after the predetermined period of time elapses, and is consequently exerted over the uppermost sheet and the second uppermost sheet substantially to pick them up together.

To tackle the above-described drawback, JP-2003-237958-A discloses a sheet feeding device having a configuration in which the surface of the dielectric belt is effectively separated from the surface of the sheet stack to cause the dielectric belt to slope upward with respect to the surface of the sheet stack after attracting the uppermost sheet to the surface of the dielectric belt contacting the sheet stack.

In this configuration, as the dielectric belt is separated from the sheet stack, the uppermost sheet that is attracted to the surface of the dielectric belt is picked up from the sheet stack. At this time, although the second uppermost sheet is likely to follow the uppermost sheet, the rigidity of the second uppermost sheet provides a force of detachment for separating the second uppermost sheet from the uppermost sheet. Generally, the force of detachment is greater than the force of attraction at the contact portion between the uppermost sheet and the second uppermost sheet due to various reasons. Consequently, even if a force of attraction is generated, the uppermost sheet can be picked up successfully without being followed by the second uppermost sheet.

With the action of detachment, a space is formed in the contact portion between the uppermost sheet and the second uppermost sheet. Once this space is formed, it is easy to separate the uppermost sheet and the second uppermost sheet. Therefore, even if the force of attraction is generated at the contact portion between the uppermost sheet and the second uppermost sheet, the uppermost sheet can separate from the second uppermost sheet successfully.

(In this specification, the terms "pick-up operation" and "picking up" refers to the action or operation in which the dielectric belt attracts the uppermost sheet of the sheet stack thereto to bring the uppermost sheet upward and crate a gap between the uppermost sheet and the immediately underlying, adjacent sheet (i.e., the second uppermost sheet).)

However, in the sheet feeding device that performs the sheet pick-up operation, a belt moving unit is required to move one end of the surface of the dielectric belt upward to angle the belt with respect to the sheet stack after the uppermost sheet is attracted to the surface of the dielectric belt contacting the upper surface of the sheet stack. The related-art sheet feeding devices include a dedicated moving mechanism, equipped with a driving source, which serves as a belt moving unit to perform the above-described sheet pick-up operation. Therefore, space just for this moving mechanism is required in the related-art sheet feeding device, which increases the size and cost of the sheet feeding device and the image forming apparatus.

SUMMARY OF THE INVENTION

The present patent application provides a novel image forming apparatus that can perform a sheet pick-up operation without employing any additional driving source dedicated to the sheet pick-up operation, thus preventing an increase in apparatus size and cost.

In one exemplary embodiment, an image forming apparatus includes an image forming device, a sheet container, a sheet feeding unit, a belt supporting mechanism, and a moving unit. The image forming device forms an image on a surface of a sheet. The sheet container contains a sheet stack including an uppermost sheet of multiple sheets to be fed to the image forming device. The sheet feeding unit is disposed above the sheet container to feed the sheet from the sheet container to the image forming device and includes an endless, dielectric belt and an electric potential pattern forming unit. The endless, dielectric belt is disposed facing an upper surface of the sheet stack to contact and attract the uppermost sheet to a surface thereof and feed the sheet in a sheet feeding direction as the dielectric belt rotates. The electric potential pattern forming unit forms an electric potential pattern on a tensioned, flat portion of the dielectric belt having multiple potential holding sections of opposite polarities disposed adjacent to each other. The belt supporting mechanism includes a first supporting member disposed upstream of the dielectric belt in a sheet feeding direction to rotate the dielectric belt and a second supporting member disposed downstream from the first supporting member. The first supporting member and the second supporting member support the dielectric belt with tension. The moving unit causes the first supporting member to rotate the dielectric belt to move the second supporting member between a sheet attracting position, at which the flat portion of the dielectric belt contacts the upper surface of the sheet stack, and a sheet feeding position, at which the flat portion of the dielectric belt moves away from the upper surface of the sheet stack at a predetermined angle to the upper surface of the sheet stack. The belt supporting mechanism supports the second supporting member to rotate about a predetermined center between the sheet attracting position and the sheet feeding position. The moving unit rotates the first supporting member in the sheet feeding direction to rotatably move the second supporting member from the sheet attracting position to the sheet feeding position so that the flat portion of the dielectric belt moves from the sheet contact position to the sheet pick-up position.

The flat portion of the dielectric belt may contact the upper surface of the sheet stack while the dielectric belt remains unrotated so as to attract the flat portion at the sheet contact position to the uppermost sheet of the sheet stack. The uppermost sheet is attracted to the flat portion of the dielectric belt by the action of an electric field generated by the electric potential pattern. The belt moving unit drives the first supporting roller to rotate the dielectric belt, which rotatably moves the second supporting member about the axis of the first supporting member between the sheet attracting position and the sheet feeding position.

The moving unit may rotate the second supporting member using the weight of the second supporting member when the first supporting member is stopped rotating, and move the flat portion of the dielectric belt from the sheet feeding position to the sheet attracting position.

The sheet container may include a side wall to align a leading edge of the sheet stack accommodated therein by abutting the leading edge against the side wall. An upper end of the side wall may be disposed higher than the upper surface of the sheet stack in a substantially vertical direction and lower than the uppermost sheet attracted to the flat portion at the sheet feeding position.

The side wall may be slanted so that the upper end thereof is located downstream from a downstream end thereof in the sheet feeding direction.

When the flat portion of the dielectric belt is located at the sheet attracting position, a downstream end of the upper surface of the sheet stack may be located downstream from a downstream end of the flat portion in the sheet feeding direction.

The sheet container may include an insulating material on an upper surface of a bottom plate of the sheet container contactable to the flat portion of the dielectric belt when no sheet stack is accommodated in the sheet container.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
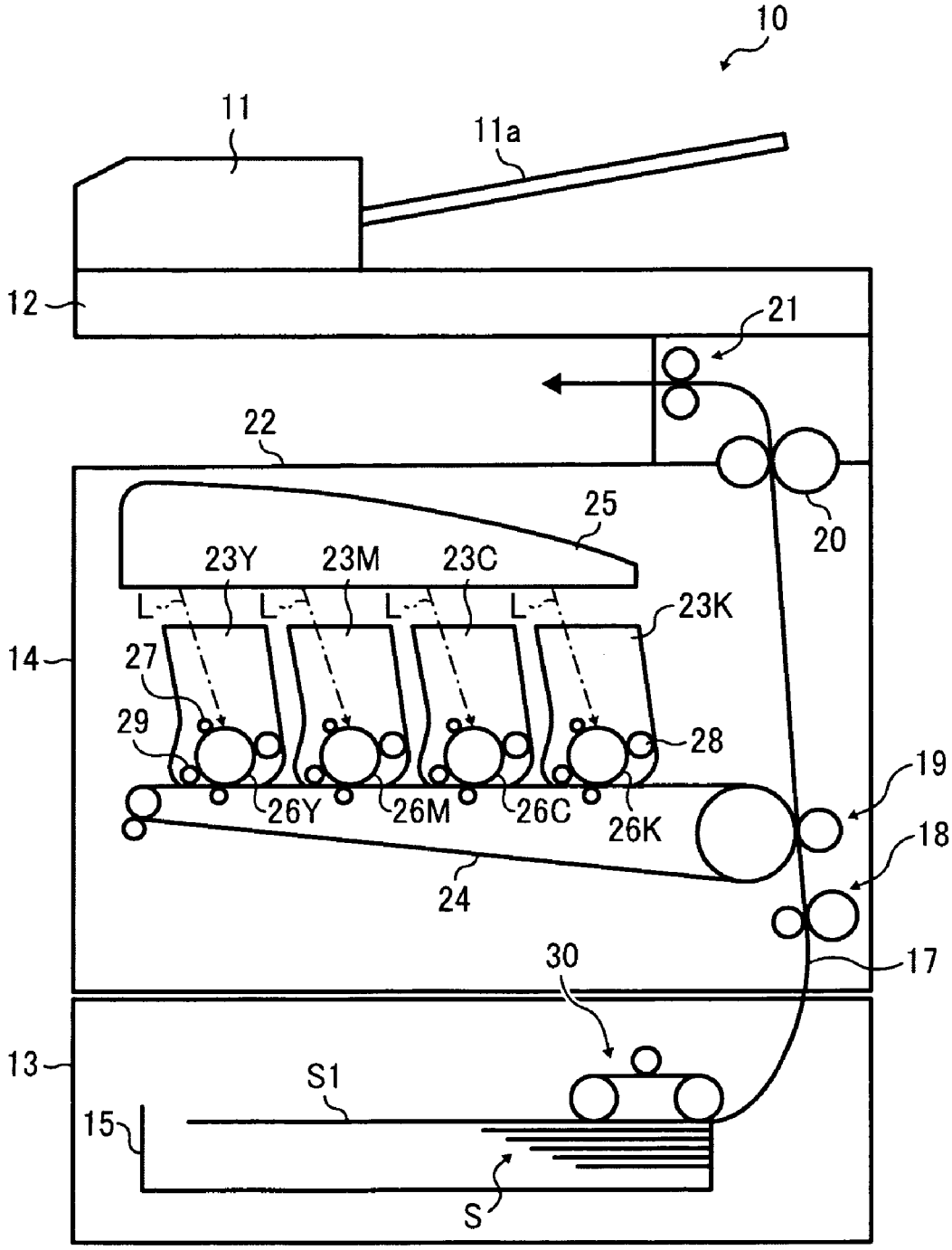
FIG. 1 is a schematic view of an image forming apparatus according to the present patent application.

It will be understood that if an element or layer is referred to as being "on", "against", "connected to" or "coupled to"

another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would hen be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present patent application.

The terminology used herein is for the purpose of describing particular embodiments only and is not intended to be limiting of the present patent application. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to the present patent application. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of exemplary embodiments of the present patent application.

The present patent application includes a technique applicable to any image forming apparatus, and is implemented in the most effective manner in an electrophotographic image forming apparatus.

In describing preferred embodiments illustrated in the drawings, specific terminology is employed for the sake of clarity. However, the disclosure of the present patent application is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present patent application are described.

FIG. 1 is a schematic view of the image forming apparatus 10 according to an exemplary embodiment of the present patent application.

In FIG. 1, the image forming apparatus 10 includes an automatic document feeder (hereinafter referred to as an "ADF") 11, a document reader 12, a sheet supplying device 13, an image forming device 14, a pair of registration rollers 18, a transfer roller 19, a fixing unit 20, a pair of sheet discharging rollers 21, and a sheet discharging tray 22.

As illustrated in FIG. 1, the image forming apparatus 10 may be a copier, a facsimile machine, a printer, a multifunction printer having at least one of copying, printing, scanning, plotter, and facsimile functions, or the like. The image forming apparatus 10 may form an image by an electrophotographic method, an inkjet method, or any other suitable method. According to this exemplary embodiment, the image forming apparatus 10 functions as a copier for forming an image on a recording medium by the electrophotographic method.

The ADF 11 is mounted on the document reader 12. The ADF 11 includes a document sheet tray 11*a* to hold a sheet stack thereon. The ADF 11 separates each sheet one by one from the sheet stack on the document sheet tray 11*a* to automatically feed the separated sheet to the document reader 12.

The document reader 12 reads image data of the sheet fed from the ADF 11 on a contact glass mounted thereon.

The sheet supplying device 13 that serves as a sheet feeding device is disposed below the image forming device 14. The sheet supplying device 13 accommodates a sheet stack S or recording media therein to supply an uppermost sheet S1 that is picked up from the sheet stack, to the image forming device 14.

The image forming device 14 forms an image on the uppermost sheet S1 supplied by the sheet supplying device 13 according to the image data read in the document reader 12.

According to this exemplary embodiment, the image forming device 14 can separate from the sheet supplying device 13 for supplying the uppermost sheet S to the image forming device 14.

The uppermost sheet S1 separated by the sheet cassette 15 travels in a sheet conveyance path 17 that passes through a nip formed between a nip formed between the pair of registration rollers 18, and a secondary transfer nip formed between the transfer roller 19 and a roller facing the transfer roller 19 with an intermediate transfer belt 24 interposed therebetween.

Through the sheet conveyance path 17, the uppermost sheet S1 is conveyed forward by the pair of registration rollers 18, and receives a toner image formed in the image forming device 14 at the secondary transfer nip of the transfer roller 19. The toner image is then fixed to the uppermost sheet S1 in the fixing unit 20 by application of heat and pressure, and is finally discharged to the sheet discharging tray 22 by the pair of sheet discharging rollers 21.

The image forming device 14 includes four image forming units 23 (specifically, an image forming unit 23Y for forming yellow toner image, an image forming unit 23C for forming cyan toner image, an image forming unit 23M for forming magenta toner image, and an image forming unit 23K for forming black toner image), the intermediate transfer belt 24 that serves as an intermediate transfer member, and an optical writing device 25.

The optical writing device 25 receives color separation image data transmitted from an external device such as a personal computer or a word processor and image data of original documents read by the document reader 12 and converts the image data to a signal for light source driving. Accordingly, the optical writing device 25 drives a semiconductor laser in each laser light source unit and emits light beams L.

The image forming units 23Y, 23C, 23M, and 23K form respective single-color toner images different from each other. The image forming units 23Y, 23C, 23M, and 23K include a photoconductor 26 (specifically, a photoconductor 23Y for carrying yellow toner image thereon, a photoconductor 26C for carrying cyan toner image thereon, a photoconductor 26M for carrying magenta toner image thereon, and a photoconductor 26K for carrying black toner image thereon), and image forming components disposed around the photoconductor 26. The image forming components included in each of the image forming units 23Y, 23C, 23M, and 23K shown in FIG. 1 are a charging unit 27, a developing unit 28, and a cleaning unit 29.

The photoconductor 26 is a cylindrical image carrier that is rotated by a drive source, not illustrated, in a clockwise direction in FIG. 1. The photoconductor 26 has a photoconductive layer as an outer surface thereof.

The charging unit 27 is disposed contacting the photoconductor 26 to uniformly charge the outer surface of the photoconductor 26. The charging unit 27 according to this exemplary embodiment employs a contact-type charging method in which a charging member such as a charging roller uniformly charges the outer surface of the photoconductor 26 by contacting or nearly contacting the outer surface of the photoconductor 26. However, a charging method is not limited thereto.

The light beams L or light spots emitted by the optical writing device 25 irradiate the outer surface of the photoconductor 26 to optically write an electrostatic latent image according to image data.

The developing unit 28 supplies toner to the outer surface of the photoconductor 26 to develop the electrostatic latent image into a visible toner image. In this exemplary embodiment, a non-contact type developing unit that does not directly contact the photoconductor 26 is employed.

The cleaning unit 29 is a brush-contact-type unit in which a brush member thereof is disposed slidably contacting the outer surface of the photoconductor 26 to remove residual toner remaining on the outer surface of the photoconductor 26.

The intermediate transfer belt 24 is an endless belt member including a resin film or a rubber material. The toner image is transferred from the photoconductor 26 onto a surface of the intermediate transfer belt 24 before being further transferred onto the uppermost sheet S1 at the secondary transfer nip formed by the transfer roller 19.

The uppermost sheet S1 having the toner image thereon is conveyed to the fixing unit 20 to be fixed to the uppermost sheet S1 by application of heat and pressure, and is finally discharged to the sheet discharging tray 22 by the pair of sheet discharging rollers 21.

Figure 2:
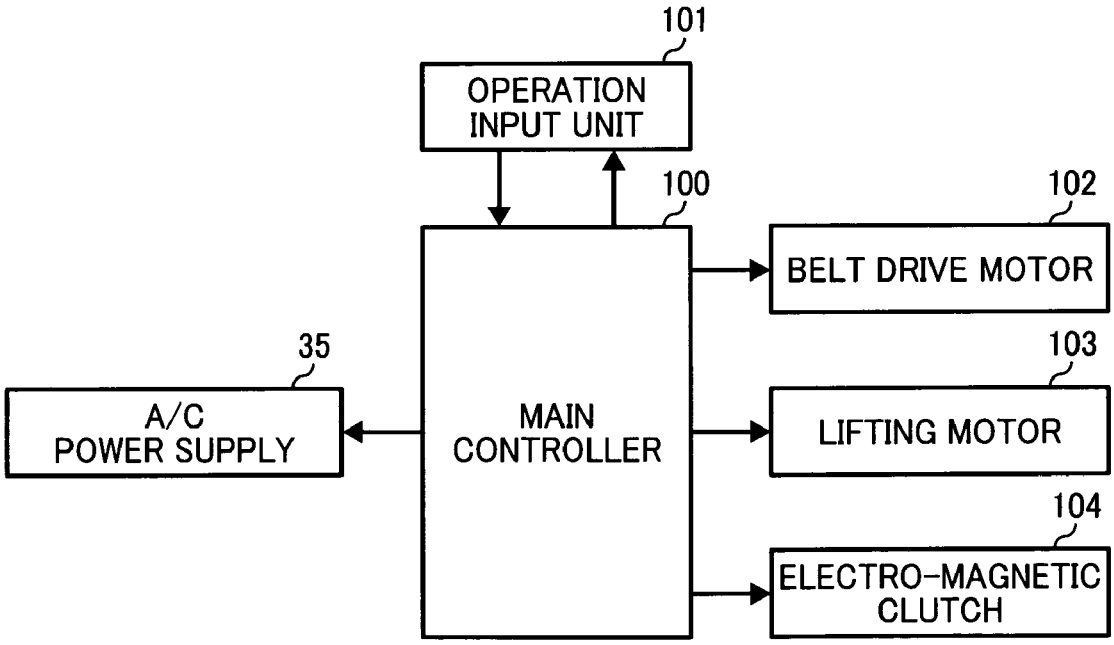
FIG. 2 is a block diagram illustrating a configuration of a control unit of the image forming apparatus shown in FIG. 1.

FIG. 2 is a block diagram illustrating a configuration of a control unit 100 provided to the image forming apparatus 10 according to an exemplary embodiment of the present patent application.

As illustrated in FIG. 2, the control unit 100 is a microcomputer that includes a central processing unit (CPU), a read-only memory (ROM), a random access memory (RAM), an input and output (I/O) interface, and the like.

The control unit 100 shown in FIG. 2 is connected to an operation input unit 101, a belt drive motor 102, a lifting motor 103, an electro-magnetic clutch 104, an alternating current (A/C) power supply 35, and other unillustrated various sensors and motors provided to the image forming apparatus 10.

The control unit 100 controls operations of the belt drive motor 102, the lifting motor 103, and the electro-magnetic clutch 104, according to signals inputted from the operation input unit 101, and so forth.

The operation input unit 101 is provided in the image forming apparatus 10 and includes various keypads such as a numeric keypad and a print start keypad, and various indicators. A user inputs sheet information such as material and size of a sheet directly or selects the sheet information via selection buttons through the operation input unit 101 when feeding the sheet by a sheet cassette 15, which will be described below. The sheet information inputted or selected by the user is converted to a signal and is outputted to the control unit 100.

The belt drive motor 102 serves as a moving unit and rotates a drive roller 31 included in a sheet feeder 30 of the sheet supplying device 13 according to the input signal from the control unit 100. The details of the drive roller 31 and the sheet feeder 30 will be described below.

The lifting motor 103 moves a contact and separation mechanism 40, details of which are described below, in a vertical direction, according to the input signal from the control unit 100.

The electro-magnetic clutch 104 is disposed between the belt drive motor 102 and the drive roller 31 and switches between opening (transmitting) and closing (blocking) the power source between the belt drive motor 102 and the drive roller 31 according to the input signal from the control unit 100.

The A/C power supply 35 supplies a charging voltage to a charging roller, described below, according to the input signal from the control unit 100.

Figure 3:
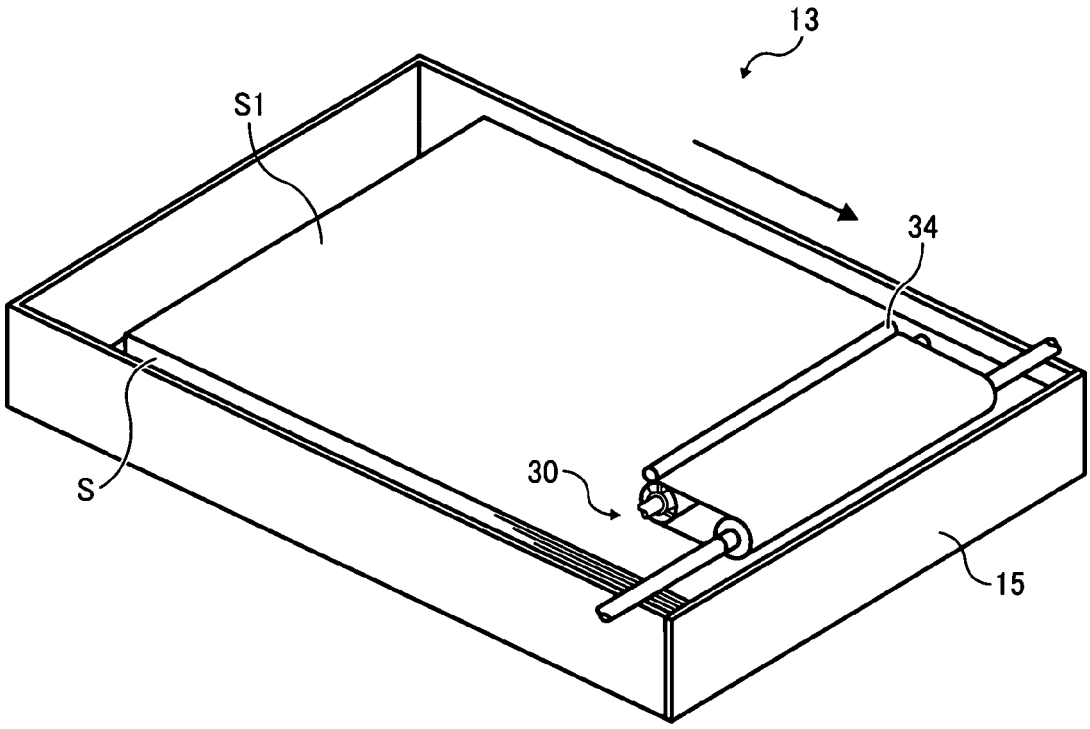
FIG. 3 is a perspective view of the sheet feeding device incorporated in the image forming apparatus shown in FIG. 1, according to the present patent application.

FIG. 3 is a perspective view of the sheet feeding device incorporated in the image forming apparatus 10.

As illustrated in FIG. 3, the sheet supplying device 13 includes a sheet cassette 15 and a sheet feeder 30. The sheet cassette 15 serves as a sheet container and loads the sheet stack S therein. The sheet feeder 30 serves as a sheet feeding unit to attract the uppermost sheet S1 placed on top of the sheet stack S thereto to pick up the uppermost sheet S1 from the sheet stack S and feed the uppermost sheet S1 in the sheet feeding direction.

The uppermost sheet S1 separated by the sheet feeder 30 travels in the sheet conveyance path 17 that passes through the nip formed between the pair of conveyance rollers 18 and the secondary transfer nip formed between the transfer roller 19 and a roller facing the transfer roller 19 with the intermediate transfer belt 24 interposed therebetween. The sheet conveyance path 17 is defined by an upper guide plate 17*b* and a lower guide plate 17*a* provided downstream from the drive roller 31 in the sheet feeding direction.

As illustrated in FIG. 3, the sheet feeder 30 is disposed above the sheet cassette 15 and employs an electrostatic sheet feed method in which the uppermost sheet S1 is picked up from the sheet stack S by being attracted by a charged dielectric belt 33, which will be described below. A width along an axial direction of the sheet feeder 30 is narrower or smaller than that of any sheet that can be loaded in the sheet cassette 15 and is disposed in the vicinity of the latitudinal center in the width direction of the loadable sheet. Alternatively, the width of the sheet feeder 30 can be equal to or greater than that of any loadable sheet. Further, two or more sheet feeders 30 can be disposed along the width of any loadable sheet while one sheet feeder 30 is provided in the vicinity of the latitudinal center in the width of the uppermost sheet S1 in the sheet supplying device 13 in FIG. 3.

Figure 4:
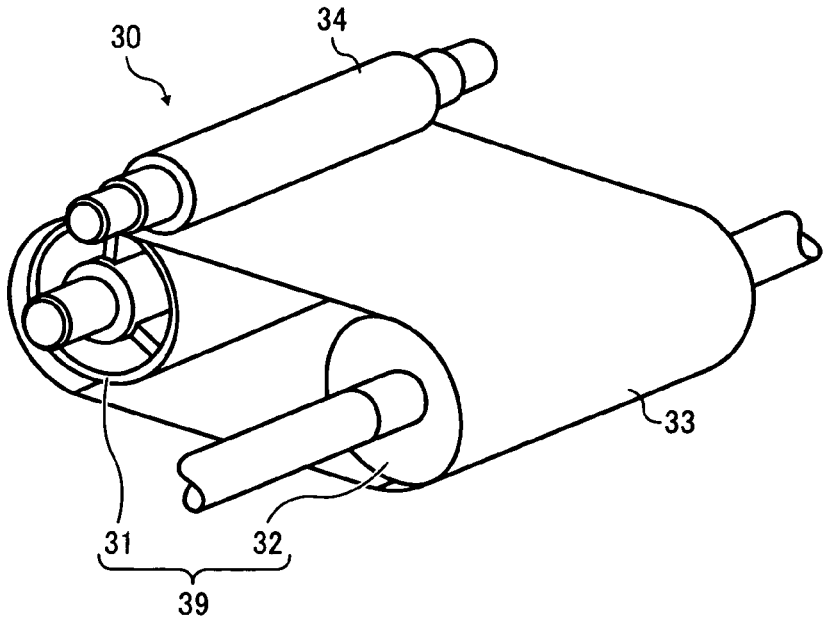
FIG. 4 is a perspective view of a sheet feeder according to the preset patent application.

FIG. 4 illustrates a perspective view of the sheet feeder 30.

As illustrated in FIG. 4, the sheet feeder 30 is includes the drive roller 31, the driven roller 32, a dielectric belt 33, and a charging roller 34. The dielectric belt 33 is looped over the drive roller 31 and the driven roller 32 that is rotated with the drive roller 31. The drive roller 31 serves as a first supporting member to support the dielectric belt 33 at an upstream end of the dielectric belt 33 in the sheet feeding direction and to transmit a driving force to rotate the dielectric belt 33, for moving the surface thereof. The driven roller 32 serves as a second supporting member to support the dielectric belt 33 at a downstream end of the dielectric belt 33 in the sheet feeding direction.

In this exemplary embodiment, the second supporting roller corresponds to the driven roller 32 but is not limited thereto. For example, the drive roller 31 may be the second supporting roller, with the driven roller as the first supporting roller.

Further, in this exemplary embodiment, as described above the dielectric belt 33 is supported by two supporting rollers, the drive roller 31 and the driven roller 32. However, the dielectric belt 33 may be supported by three or more supporting rollers.

The charging roller 34 is an electrode and extends along the width of the dielectric belt 33. The charging roller 34 contacts the surface of the dielectric belt 33 to serve as a potential pattern forming member to form predetermined potential patterns on the surface of the dielectric belt 33.

Figure 5:
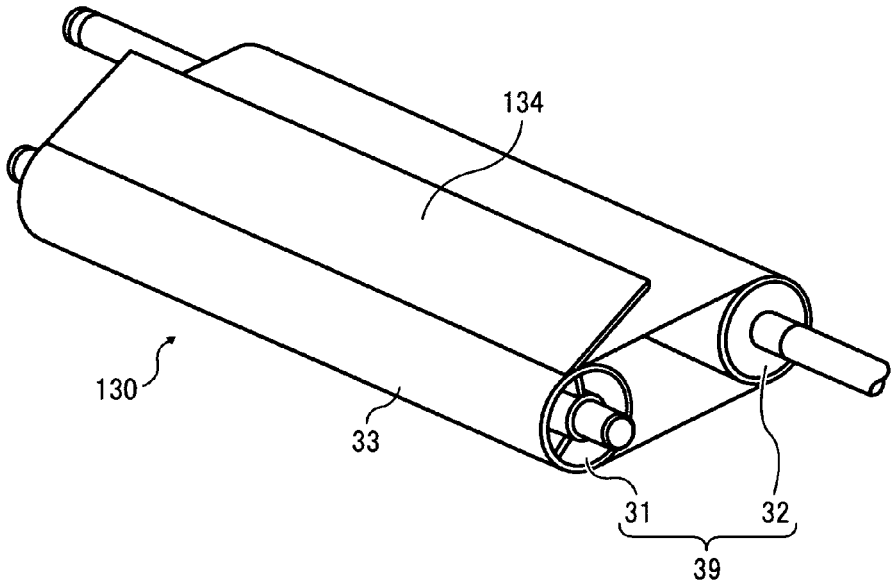
FIG. 5 is a perspective view of a modification of the sheet feeder shown in FIG. 4, according to the present patent application.

In this exemplary embodiment, the charging roller 34 is employed as an electric potential pattern forming unit. However, as shown in FIG. 5, a modified sheet feeder 130 can employ a blade-type charging member 134 as the electric potential pattern forming unit.

Figure 6:
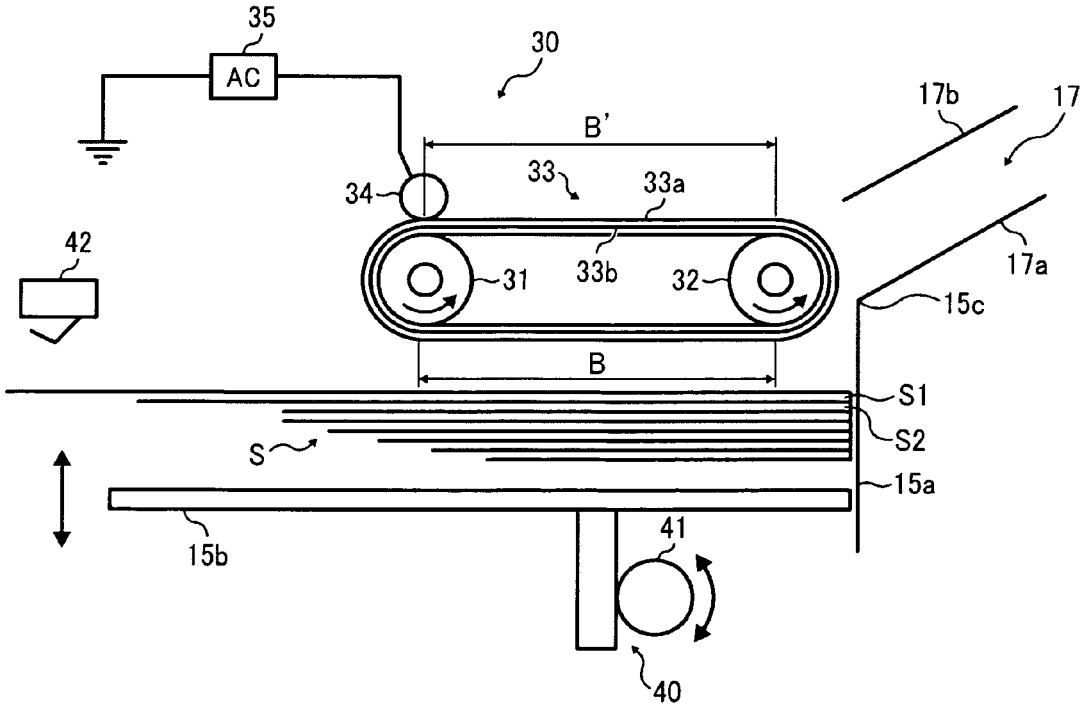
FIG. 6 is a side view of the sheet feeding device shown in FIG. 1, according to the present patent application.

FIG. 6 illustrates a schematic configuration of the sheet feeder 30 and other units in the sheet supplying device 13.

As illustrated in FIG. 6, the dielectric belt 33 according to this exemplary embodiment is looped over the drive roller 31 and the driven roller 32. The dielectric belt 33 has a multilayer construction that includes a front layer 33*a* having a resistivity of about $10^8$ Ω·cm or greater (for example, a polyethylene terephthalate film having a thickness of about 100 μm), and a back layer 33*b* having a resistivity of about $10^6$ Ω·cm or smaller to maintain a good charging state.

The dielectric belt 33 is not limited to having a double-layer structure but may instead have a single-layer structure or a structure having three or more layers. The charging roller 34 can be disposed at any position on the front layer 33*a*. However, as described in this exemplary embodiment, it is preferable to locate the charging roller 34 above the drive roller 31 that is fixedly arranged. By so doing, even when the charging roller 34 is disposed such that the weight of the charging roller 34 is on the dielectric belt 33, the weight of the charging roller 34 can reduce an adverse effect on the pressure of the contact between the dielectric belt 33 and the upper surface of the sheet stack S. Further, the dielectric belt 33 can be disposed at any position facing the sheet stack S where it is possible to obtain a sufficient area on the surface for attracting the sheet stack S, and the surface contacts the leading edge area or the downstream area of the uppermost sheet S1 in the sheet feeding direction.

An outer surface of the drive roller 31 includes a conductive rubber layer having a resistivity of about $10^6$ Ω·cm. An inner part of the conductive rubber layer of the drive roller 31 includes a rubber material having a resistivity of about $10^6$ Ω·cm. Both the surface and the inner part of the driven roller 31 include metal. It is to be noted that the drive roller 31 and the driven roller 32 are electrically grounded. The driven roller 32 has a small diameter suitable to remove the uppermost sheet S1 from the dielectric belt 33 by a curvature of the dielectric belt 33. For example, the great curvature caused by the small diameter of the driven roller 32 separates the uppermost sheet S1 attracted by the dielectric belt 33 from the surface of the dielectric belt 33 looped over the driven roller 32, and the dielectric belt 33 driven by the drive roller 31 feeds the removed uppermost sheet S1 toward the sheet conveyance path 17 that is defined by the upper guide plate 17*b* and the lower guide plate 17*a* provided downstream from the drive roller 31 in the sheet feeding direction.

The charging roller 34 is disposed to contact the outer surface of the dielectric belt 33 in the vicinity of which the dielectric belt 33 is looped over the drive roller 31. The charging roller 34 is connected to the A/C power supply 35 that generates alternating current. The voltage to be applied to the charging roller 34 can be any alternating voltage such as a voltage formed by sine waves. Further, instead of the alternating current, the charging power supply 35 may apply a direct current in which high and low potentials are alternately provided. According to this example embodiment, the charging power supply 35 applies an alternating current having amplitude of about 4 KV to the surface of the dielectric belt 33.

An electric discharging unit to electrically discharge the charges on the surface of the dielectric belt 33 can be disposed upstream from the charging roller 34 in the belt moving direction in which the lower surface of the dielectric belt 33 facing the uppermost sheet S1 moves and downstream from the sheet feeding position where the uppermost sheet S1 separates from the dielectric belt 33.

The sheet cassette 15 that accommodates the sheet stack S further includes a side wall 15*a*, the lower guide plate 17*a*, the upper guide plate 17*b*, and a connecting point 15*c* where the side wall 15*a* and the lower guide plate 17*a* meet, as illustrated in FIG. 6. The side wall 15*a* that serves as a sheet regulator, the upper guide plate 17*b*, and the lower guide plate 17*a* are provided downstream from the dielectric belt 33 in the sheet feeding direction, which is the leading edge area of a sheet, on the right side as illustrated in FIG. 6.

In this exemplary embodiment, the upper guide plate 17*b* and the lower guide plate 17*a* regulate the uppermost sheet S1 in the sheet feeding direction after the sheet is conveyed to the sheet conveyance path 17 by the sheet feeder 30, and define a part of the sheet conveyance path 17.

A point of intersection, i.e., the connecting point 15*c* that connects the upper end of the side wall 15*a* and the lower end of the lower guide plate 17*a*, is located higher than the position of the uppermost sheet S1 of the sheet stack S placed on the bottom plate 15*b* and lower than the surface of the dielectric belt 33 facing the sheet stack S constantly. The connecting point 15*c* is formed to have an angled corner in this exemplary embodiment but is not limited thereto. For example the connecting point 15*c* can be a curved surface.

The sheet feeder 30 according to this exemplary embodiment includes the contact and separation mechanism 40 that is driven by the lifting motor 103 and serves as a contact and separation unit to contact the dielectric belt 33 to the surface of the sheet stack S.

The contact and separation mechanism 40 includes a rack and pinion type sheet pressing member 41 to move a bottom plate 15*b* of the sheet cassette 15 in a vertical direction while the bottom plate 15*b* remains horizontal. In this exemplary embodiment, the contact and separation mechanism 40 moves the sheet stack S vertically but does not move the sheet feeder 30 in the vertical direction. Alternatively, the contact and separation mechanism 40 can move only the bottom plate 15*b* in the vertical direction or move both the bottom plate 15*b* and the sheet feeder 30.

The contact and separation mechanism 40 of this exemplary embodiment further includes a sensor 42 to detect a position of the upper surface of the sheet stack S in the vertical direction. The lifting motor 103 illustrated in FIG. 2 causes the contact and separation mechanism 40 to control vertical movements of the bottom plate 15*b* of the sheet cassette 15 according to detection results obtained by the sensor 42. The contact and separation mechanism 40 further maintains a proper gap between the upper surface of the sheet stack S and the lower surface of the dielectric belt 33 and a suitable contact pressure generated between the dielectric belt 33 and the sheet stack S. Therefore, in this exemplary embodiment, regardless of the volume or number of sheets in the sheet stack S, a substantially equal contact pressure can be maintained. Different from a contact pressure employed in the sheet separation method using an existing frictional force, it is sufficient to provide a contact pressure for the dielectric belt 33 that is just enough to contact the upper surface of the sheet stack S. By setting the contact pressure, it is be less possible to feed the second uppermost sheet S2 together with the uppermost sheet S1.

As described above, in this exemplary embodiment, the dielectric belt 33 is extendedly supported by the drive roller 31 and the driven roller 32, which forms at least two tensioned, flat portions in the dielectric belt 33. One of the tensioned, flat portions faces the upper surface of the sheet stack S, which is hereinafter referred to as a lower flat portion B. In this exemplary embodiment, the driven roller 32 is supported to rotate about the axis of the drive roller 31.

As previously described, the belt drive motor 102 in this exemplary embodiment drives the drive roller 31 to rotate the dielectric belt 33 and also serves as the moving unit to move the lower flat portion B of the dielectric belt between a sheet contact position, at which the lower flat portion B of the dielectric belt 33 contacts the upper surface of the sheet stack S, and a sheet pick-up position, at which the lower flat portion B of the dielectric belt 33 picks up the uppermost sheet S1 from the upper surface of the sheet stack S.

As the dielectric belt 33 is driven by the belt drive motor 102 to rotate the dielectric belt 33, the driven roller 32 rotates about the axis of the drive roller 31 to move between a sheet attracting position, which corresponds to the sheet contact position of the lower flat portion B of the dielectric belt 33, and a sheet feeding position, which corresponds to the sheet pick-up position of the lower flat portion B of the dielectric belt 33. While the drive roller 31 is rotating, the driven roller 32 remains positioned at the sheet feeding position. It should be noted that, hereinafter, a state in which the lower flat portion B of the dielectric belt 33 is at the sheet contact position corresponds to a state in which the driven roller 32 is at the sheet attracting position, and a state in which the lower flat portion B of the dielectric belt 33 is at the sheet pick-up position corresponds to a state in which the driven roller 32 is at the sheet feeding position.

Next, a detailed description is given of an operation of feeding the uppermost sheet S1 toward the sheet conveyance path 17.

Figure 7A:
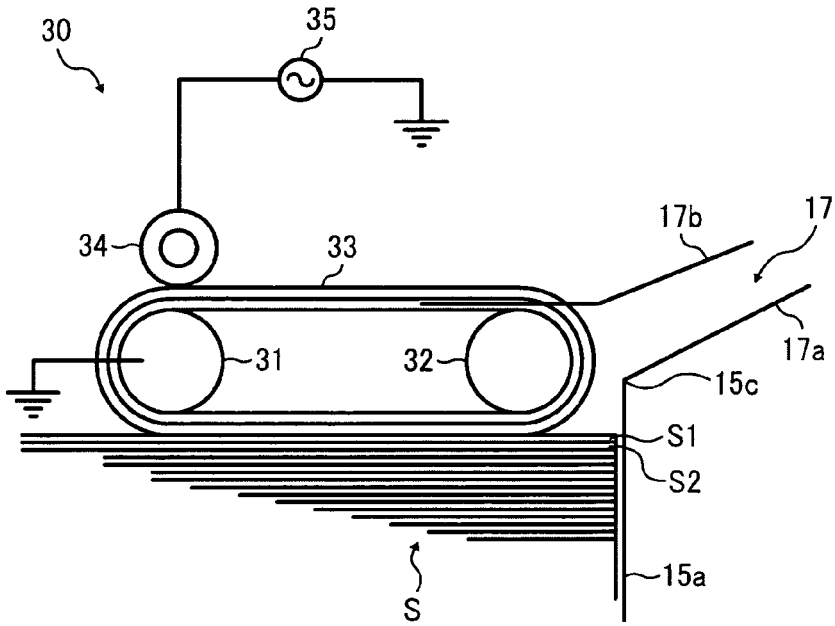
FIG. 7A is a side view of the sheet feeding device of FIG. 6 when a belt pressing roller is at a sheet attracting position.
Figure 7B:
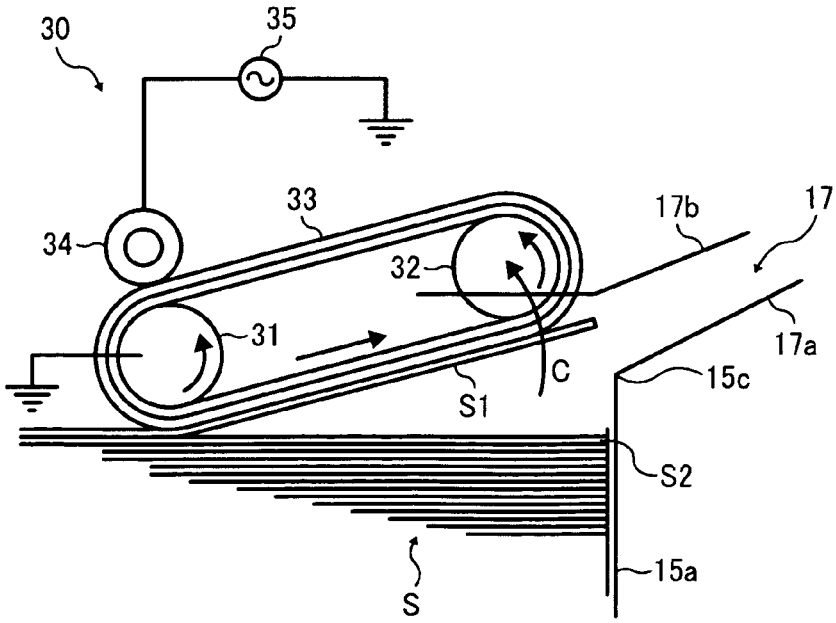
FIG. 7B is a side view of the sheet feeding device of FIG. 6 when the belt pressing roller is at a sheet feeding position.
Figure 7C:
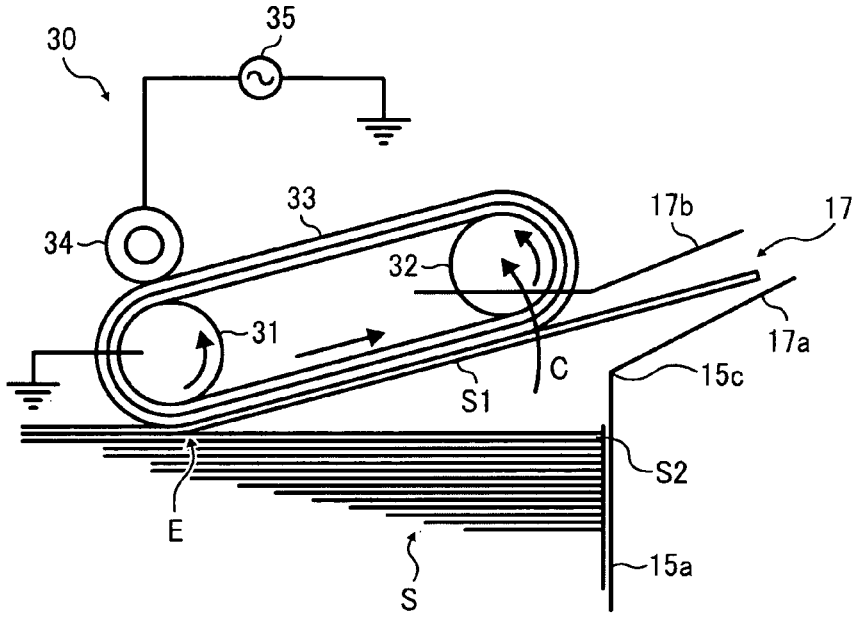
FIG. 7C is a side view of the sheet feeding device of FIG. 6 when the dielectric belt conveys an uppermost sheet attracted thereto toward a conveyance path while picking up the uppermost sheet from the sheet stack.

FIG. 7A illustrates a state in which the lower flat portion B of the dielectric belt 33 is located at the sheet contact position. FIG. 7B illustrates a state in which the lower flat portion B of the dielectric belt 33 is located at the sheet pick-up position. FIG. 7C illustrates a state in which the uppermost sheet S1 attracted to the lower flat portion B of the dielectric belt 33 is conveyed toward the sheet conveyance path 17.

When the control unit 100 transmits a sheet feeding signal, the electro-magnetic clutch 104 provided to a driving force transmission system of the drive roller 31 is turned on while the dielectric belt 33 and the sheet stack S are not in contact with each other, as illustrated in FIG. 6. This action transmits a driving force to the drive roller 31 to start.

Then, the charging roller 34 that is connected to the A/C power supply 35 applies an alternating voltage to the dielectric belt 33 in rotation. Consequently, the electric potential patterns or charge patterns of positive potential holding section and negative potential holding section are alternately formed on the surface of the dielectric belt 33, at pitches or intervals according to the frequency of the A/C power supply 35 and the rotation speed (e.g., the circumferential speed) of the dielectric belt 33. The electric potential patterns or the charge patterns are alternately provided on the front layer 33*a* of the dielectric belt 33 in a direction in which the lower flat portion B of the dielectric belt 33 moves. Namely, the dielectric belt 33 is charged with the alternating voltage. The pitch of a pair of positive potential holding section and negative potential holding section disposed adjacent to each other is preferably in a range of from 2 mm to 15 mm, and more preferably from 2 mm to 4 mm.

When the rotation of the drive roller 31 starts, a tension is exerted on an upper flat portion B' of the dielectric belt 33, which is greater than a tension that is exerted on the lower flat portion B of the dielectric belt 33. Due to this difference in tension between the upper flat portion B' and the lower flat portion B, the driven roller 32 in this exemplary embodiment rotates about the axis of the drive roller 31 in a counterclockwise direction in FIGS. 7B and 7C, which is a direction C, indicated by arrow C. Namely, the driven roller 32 moves from the sheet attracting position to the sheet feeding position. Accordingly, the electric potential patterns are formed on the surface of the dielectric belt 33 while the driven roller 32 remains at the sheet feeding position.

When the electric potential patterns are successfully formed on at least the lower flat portion B of the dielectric belt 33, the control unit 100 turns off the electro-magnetic clutch 104 so as to stop the drive roller 31 from rotating. When the rotation of the drive roller 31 is stopped, a restorative force is generated to restore the uneven tension exerted over the dielectric belt 33 to its original even tension. The sheet feeder 30 according to this exemplary embodiment utilizes the restorative force and the weight of the driven roller 32 to rotate the driven roller 32 in a clockwise direction, which is a direction opposite to the direction C as illustrated in FIGS. 7B and 7C. Namely, the driven roller 32 is moved from the sheet feeding position to the sheet attracting position again and the lower flat portion B of the dielectric belt 33 is moved to the sheet contact position parallel to the upper surface of the sheet stack S.

Then, the contact and separation mechanism 40 causes the upper surface of the sheet stack S to contact the entire lower flat portion B of the dielectric belt 33 that remains unrotated, as illustrated in FIG. 7A. With this action, as illustrated in FIG. 6, when the lower flat portion B of the dielectric belt 33 is located in the sheet contact position, the downstream end (i.e., the leading area) of the upper surface of the sheet stack S in the sheet feeding direction is positioned downstream from the downstream end (i.e., the leading area) of the lower flat portion B of the dielectric belt 33 in the sheet feeding direction. With this structure, compared to the structure in which the leading area of the upper surface of the sheet stack S is positioned upstream from the leading area of the lower flat portion B of the dielectric belt 33, a greater contact area between the dielectric belt 33 and the uppermost sheet S1 can be obtained in the sheet pick-up operation, thereby reliably performing the sheet pick-up operation.

When the contact and separation mechanism 40 remains at its home position, that is, does not move up to cause the lower flat portion B of the dielectric belt 33 to contact the upper surface of the sheet stack S, it is not necessary to move the driven roller 32 to the sheet feeding position. Therefore, the driven roller 32 can be prohibited to rotate about the drive roller 31 to move from the sheet attracting position to the sheet feeding position. For example, a stopper may be provided to operate in synchronization with the contacting and separating operation of the contact and separation mechanism 40 so as to prohibit the movement of the driven roller 32. For example, the stopper can keep the driven roller 32 unrotated so as not to move to the sheet feeding position while the lower flat portion B of the dielectric belt 33 and the upper surface of the sheet stack S are not in contact with each other.

When the lower flat portion B of the dielectric belt 33 having electric potential pattern holding sections thereon contacts the upper surface of the sheet stack S, a non-uniform electric field formed by the electric positive and negative charge patterns on the lower flat portion B of the lower flat portion B of the dielectric belt 33 generates applies Maxwell stress that attracts the uppermost sheet S1 to the dielectric belt 33 and holds it there.

Generally, the force of attraction generated by the electric potential pattern to the dielectric belt 33 is exerted on the uppermost sheet S1, the second uppermost sheet S2, and, in some cases, any subsequent sheets for a predetermined period of time from the moment the dielectric belt 33 contacts the sheet stack S before being picked up from the sheet stack S. However, after the predetermined period of time has elapsed, the force of attraction acts on the uppermost sheet S1 only. Namely, the force of attraction does not act on the second uppermost sheet S2 and other subsequent sheets. Therefore, in theory, the uppermost sheet S1 can be picked up from other sheets in the sheet stack S by waiting for the predetermined time. However, it is known that, in reality, even after the predetermined period of time, the second uppermost sheet S2 can be still picked up together with the uppermost sheet S1 due to various reasons.

In this exemplary embodiment, after the predetermined period of time from the moment the dielectric belt 33 contacts the upper surface of the sheet stack S elapses, the control unit 100 turns on the electro-magnetic clutch 104 so that the drive roller 31 starts rotating. As the surface of the dielectric belt 33 moves, the A/C power supply 35 forms the electric potential patterns on the surface of the dielectric belt 33.

When the drive roller 31 starts rotating, the driven roller 32 receives a net force from where the driven roller 32 contacts the inner surface of the dielectric belt 33 in rotation. The net force includes a component to rotate the driven roller 32 about the drive roller 31 in a direction in which the lower flat portion B of the dielectric belt 33 is moved from the sheet contact position to the sheet pick-up position. Therefore, by rotating the drive roller 31 in a direction for the sheet pick-up operation, the driven roller 32 rotates about the axis of the drive roller 31 in the direction C to move to the sheet feeding position. As a result, as illustrated in FIG. 7B, the lower flat portion B of the dielectric belt 33 is moved and located to the sheet pick-up position. At this time, the uppermost sheet S1 is attracted to the lower flat portion B of the dielectric belt 33. Therefore, as the lower flat portion B of the dielectric belt 33 moves to the sheet pick-up position, the uppermost sheet S1 attracted to the lower flat portion B of the dielectric belt 33 moves away from the second uppermost sheet S2 of the sheet stack S.

Even if the second uppermost sheet S2 remains attracted to the uppermost sheet S1, the uppermost sheet S1 and the second uppermost sheet S2 can be separated easily. As previously described in this exemplary embodiment, when the lower flat portion B of the dielectric belt 33 is at the sheet contact position, the leading area of the upper surface of the sheet stack S is located downstream from the leading area of the lower flat portion B. Therefore, the force of attraction caused by the electric potential patterns formed on the dielectric belt 33 is not generated at the leading area of the uppermost sheet S1 and the leading area of the second uppermost sheet S2. Consequently, the force of attachment generated therebetween is smaller than the force of attachment generated between the contact portion of the uppermost sheet S1 on which the force of attraction is generated due to the electric potential patterns and the corresponding portion on the second uppermost sheet S2. Further, a force of detachment (described in detail below) that detaches the second uppermost sheet S2 from the leading area of the uppermost sheet S1 acts at the leading area of the second uppermost sheet S2 due to the rigidity and weight of the second uppermost sheet S. As a result, the leading area of the uppermost sheet S1 and the leading area of the second uppermost sheet S2 easily separate from each other, and a predetermined angle is formed between the lower flat portion B of the dielectric belt 33 and the upper surface of the sheet stack S, forming a space or gap therebetween. Once such a gap is formed, the force of detachment acts due to the rigidity and weight of the second uppermost sheet S2, so that the uppermost sheet S1 and the second uppermost sheet S2 adhering to each other are separated rapidly with the leading area of the uppermost sheet S1 toward the upstream side of the sheet feeding direction, and the contact portion of the uppermost sheet S1 is separated from the corresponding contact portion of the second uppermost sheet S2 quickly. Thus, the uppermost sheet S1 picked up from the sheet stack S is attracted to the dielectric belt 33 in rotation, and is conveyed in the sheet feeding direction along the lower flat portion B of the dielectric belt 33, as illustrated in FIG. 7C.

In this exemplary embodiment, by feeding the uppermost sheet S1 as described above, a force generated for conveying the uppermost sheet S1 forward acts as the force of detachment. The force of detachment in this exemplary embodiment detaches the second uppermost sheet S2 from the uppermost sheet S1 at the contact portion where the uppermost sheet S1 and the second uppermost sheet S2 contact each other, which is located downstream from the leading area of the lower flat portion B of the dielectric belt 33 in the sheet feeding direction, and at a boundary E (illustrated in FIG. 7C) formed between a contact portion where the uppermost sheet S1 contacts the lower flat portion B of the dielectric belt 33 and a removing portion where the second uppermost sheet S2 is removed from the uppermost sheet S1. As a result, even if the uppermost sheet S1 and the second uppermost sheet S2 remain in contact with each other at the contact portion, the uppermost sheet S1 can be separated from the second uppermost sheet S2 by using the force of detachment.

After the uppermost sheet S1 is fed as described above, the control unit 100 turns off the electro-magnetic clutch 104 to stop the rotation of the drive roller 31. Consequently, due to the weight, the driven roller 32 rotates about the drive roller 31 in a clockwise direction to the sheet attracting position, so that the lower flat portion B of the dielectric belt 33 contacts the upper surface of the sheet stack S as shown in FIG. 6A, to be ready to start a subsequent sheet feeding operation.

As described above, the image forming apparatus 10 according to this exemplary embodiment of the present patent application includes the image forming device 14, the sheet cassette 15, the sheet feeder 30, the belt supporting mechanism 39, and the belt drive motor 102. The image forming device 14 forms from an image on the uppermost sheet S1. The sheet cassette 15 that serves as a sheet container to contain the sheet stack S including the uppermost sheet S1 of multiple sheets to be fed to the image forming device 14. The sheet feeder 30 serves as a sheet feeding unit to feed the uppermost sheet S1 to the image forming device 14. The sheet feeder 30 includes the endless, dielectric belt 33, the charging roller 34, and the A/C power supply 35. The dielectric belt 33 is disposed facing an upper surface of the sheet stack to contact and attract the uppermost sheet to the dielectric belt and feed the sheet in a sheet feeding direction as the dielectric belt rotates. The charging roller 34 and the A/C power supply 35 serve as an electric potential pattern forming unit to form an electric potential pattern on the tensioned, flat portions B and B' of the dielectric belt 33 having multiple potential holding sections of opposite polarities disposed adjacent to each other. The belt supporting mechanism 39 includes the drive roller 31 serving as a first supporting member disposed upstream of the dielectric belt 33 in the sheet feeding direction to rotate the dielectric belt 33 and the driven roller 32 serving as a second supporting member disposed downstream from the drive roller 31. The drive roller 31 and the driven roller 32 support the flat portions B and B' of the dielectric belt 33 with tension. The belt drive motor 102 that serves as a moving unit causes the drive roller 31 to rotate the dielectric belt 33 to move the driven roller 32 between the sheet attracting position, at which the lower flat portion B of the dielectric belt 33 contacts the upper surface of the sheet stack S, and the sheet feeding position, at which the lower flat portion B of the dielectric belt 33 moves away from the upper surface of the sheet stack S at a predetermined angle to the upper surface of the sheet stack S. The belt supporting mechanism 33 supports the driven roller 32 to rotate about the axis of the drive roller 331 between the sheet attracting position and the sheet feeding position. The belt drive motor 102 rotates the drive roller 31 in the sheet feeding direction to rotatably move the driven roller 32 from the sheet attracting position to the sheet feeding position so that the lower flat portion B of the dielectric belt 33 moves from the sheet contact position to the sheet pick-up position. The lower flat portion B of the dielectric belt 33 contacts the upper surface of the sheet stack S while the dielectric belt 33 remains unrotated so as to attract the lower flat portion B at the sheet contact position to the uppermost sheet S1 of the sheet stack S, with the uppermost sheet S1 attracted to the lower flat portion B of the dielectric belt 33 by the action of an electric field generated by the electric potential pattern formed by the charging roller 34 and the A/C power supply 35 on the lower flat portion B of the dielectric belt 33. The belt drive motor 102 drives the drive roller 31 to rotate the dielectric belt 33, which rotatably moves the driven roller 32 about the axis of the drive roller 31 between the sheet attracting position and the sheet feeding position.

According to the above-described configuration and operation, by using a driving force of rotation of the drive roller 31 generated when the uppermost sheet S1 that is attracted to the lower flat portion B of the dielectric belt 33 is fed to the sheet conveyance path 17 as the dielectric belt 33 rotates, the driven roller 32 is moved to the sheet feeding position and, as a result, the lower flat portion B of the dielectric belt 33 with the uppermost sheet S1 attracted can be moved to the sheet pick-up position. Namely, with the configuration according to this exemplary embodiment, the belt drive motor 102 for driving the drive roller 31 is also used for moving the driven roller 32 to change the position of the lower flat portion B of the dielectric belt 33, that is, any additional motor or unit is not used for changing the positions of the driven roller 32 and the dielectric belt 33. Therefore, compared to related-art image forming apparatuses, the image forming apparatus 10 that employs this configuration can achieve a reduction in size and cost.

Further, in this exemplary embodiment, the sheet cassette 15 includes the side wall 15*a*. The leading edges of sheets in the sheet stack S contained in the sheet cassette 15 contacts the side wall 15*a* to jog the sheet stack S. The connecting point 15*c* is located higher than the upper surface of the sheet stack S in a vertical direction and is lower than the uppermost sheet S1 attracted to the lower belt tensioned portion of the dielectric belt 33 at the sheet pick-up position in the vertical direction. Therefore, even if the second uppermost sheet S2 remains contacted to the uppermost sheet S1 when the uppermost sheet S1 is conveyed toward the sheet conveyance path 17, the leading edge of the second uppermost sheet S2 contacts the side wall 15*a*, thereby preventing the leading edge of the second uppermost sheet S2 from advancing downstream from the leading edges of sheets in the sheet stack S and thus preventing double-feeding. Accordingly, the position of the leading edge of sheet to be fed can be stable in the sheet feeding operation.

Figure 8:
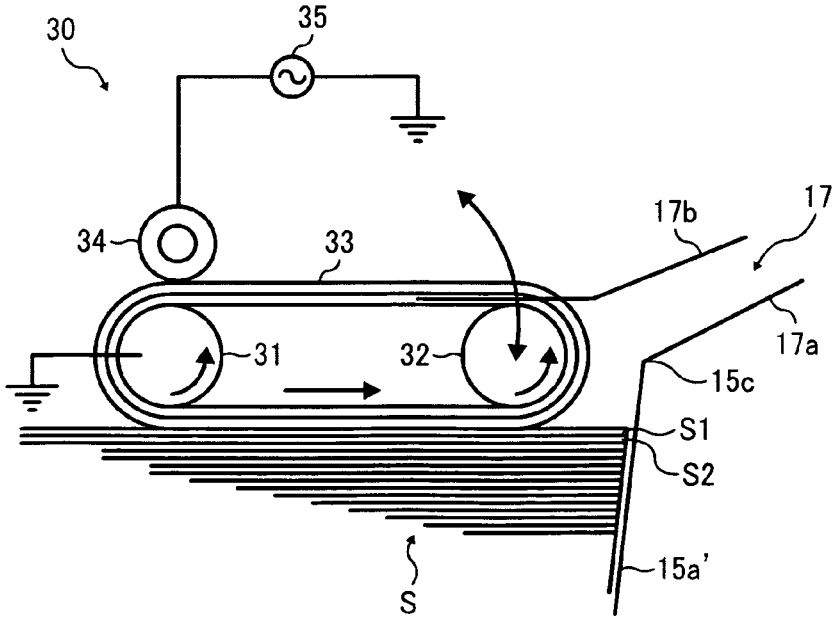
FIG. 8 is a side view of a modification of the sheet feeding device, in which a sheet conveyance roller is added thereto.

Here, FIG. 8 illustrates a side view of the sheet feeder 30 and a slanted side wall 15*a'*.

The driven roller 32 of the dielectric belt 33 rotates about the axis of the drive roller 31, as indicated by arrow illustrated in FIG. 8. Similarly, the lower flat portion B of the dielectric belt 33 moves between the sheet contact portion and the sheet pick-up position.

As illustrated in FIG. 8, the slanted side wall 15*a*' can be angled downstream from the uppermost sheet S1, so that the top of the slanted side wall 15*a*' is farther downstream than the bottom of the slanted side wall 15*a*' in the sheet feeding direction.

In this case, as illustrated in FIG. 8, the leading edge of the sheet stack S is aligned so as to be inclined to a downstream side from bottom to top along the slope of the slanted side wall 15*a*' in the sheet feeding direction. Consequently, the leading edge of a sheet in the sheet stack S is located downstream from the leading edge of an immediately underlying, adjacent sheet in the sheet stack S. This configuration is effective to decrease a force of attraction exerted between the leading edges of the sheets due to cutting burrs made when cutting the sheet stack S when a fresh new sheet stack is placed in the sheet cassette 15. In addition, an effect of loosening the sheets in the sheet stack S can be expected.

Further, in this exemplary embodiment, when the lower flat portion B of the dielectric belt 33 is at the sheet contact position, the downstream end of the upper surface of the sheet stack S is located downstream from the downstream end of the lower flat portion B of the dielectric belt 33 in the sheet feeding direction. With this configuration, as previously described, compared to the structure in which the leading edge of the upper surface of the sheet stack S is positioned upstream from the leading edge of the lower flat portion B of the dielectric belt 33, a greater contact area between the dielectric belt 33 and the uppermost sheet S1 can be obtained in the sheet pick-up operation, thereby reliably performing the sheet pick-up operation.

Moreover, since the force of attraction caused by the electric potential patterns is not generated at the downstream end (i.e., the leading area) of the uppermost sheet S1 and the downstream end (i.e., the leading area) of the second uppermost sheet S2, the force of attachment generated therebetween is smaller than the force of attachment generated between the contact portion of the uppermost sheet S1 on which the force of attraction is generated due to the electric potential patterns and the corresponding contact portion on the second uppermost sheet S2. Further, the force of detachment to detach the second uppermost sheet S2 from the leading edge of the uppermost sheet S1 acts at the leading area of the second uppermost sheet S2 due to the rigidity and own weight of the second uppermost sheet S. As a result, the leading area of the uppermost sheet S1 and the leading area of the second uppermost sheet S2 can easily separate from each other, forming a space or gap therebetween. Therefore, as described above, the second uppermost sheet S2 can be rapidly separated from the attracted portion of the uppermost sheet S1 to the upstream side of the sheet feeding direction by the force of detachment due to the rigidity and weight of the second uppermost sheet S2, and the contact portion of the uppermost sheet S1 can be separated from the corresponding contact the second uppermost sheet S2 quickly.

Further, in this exemplary embodiment, the sheet cassette 15 includes the bottom plate 15*b* having an upper face formed by an insulating material over the area on which the lower flat portion B of the dielectric belt 33 may contact. With this configuration, even when the sheet cassette 15 contains only a few sheets left in the sheet stack S on the bottom plate 15*b*, the uppermost sheet S1 can be attracted reliably. More particularly, the area on which the lower flat portion B of the dielectric belt 33 rests can be formed of an insulating material while the other part of the upper face of the bottom plate 15*b* is formed of a metallic material. With this configuration, while maintaining the rigidity of the sheet cassette 15, even when the sheet cassette 15 contains only a few sheets left in the sheet stack S on the bottom plate 15*b*, the uppermost sheet S1 can be attracted reliably.

In this exemplary embodiment, the sheet feeder 30 includes the dielectric belt 33 that includes the surface charged from outside, but is not limited thereto. For example, instead of the dielectric belt 33, the sheet feeder 30 can employ a dielectric belt 233 that has a structure as shown in FIG. 9.

Figure 9:
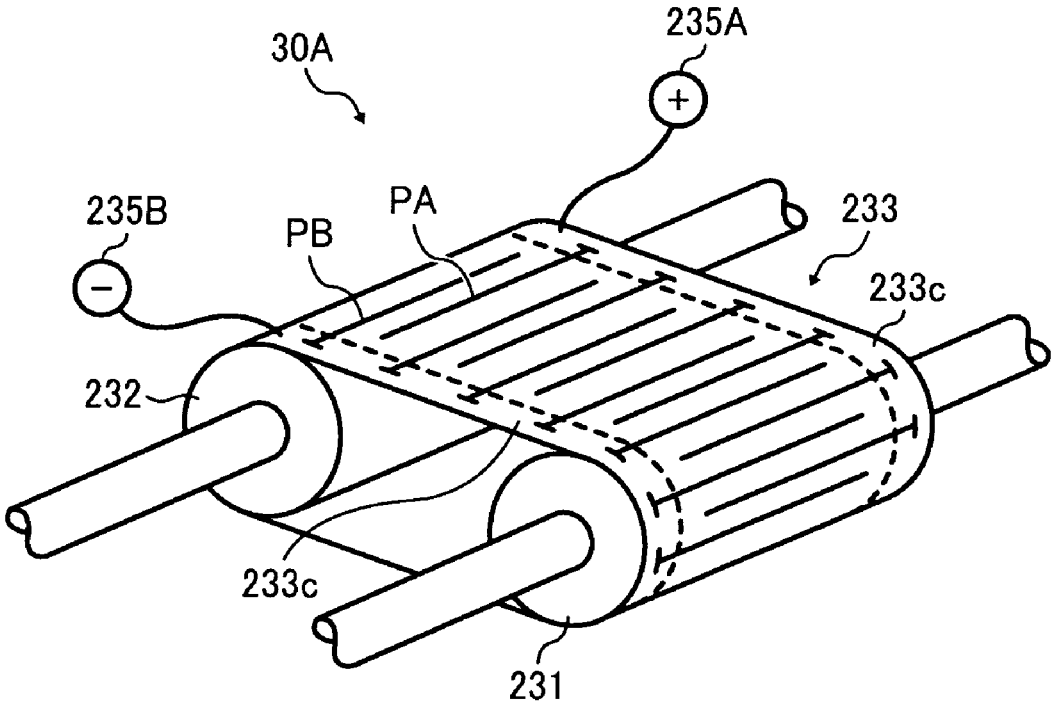
FIG. 9 is a perspective view of another example of potential patterns formed by an electric potential pattern forming unit according to the present patent application.

FIG. 9 is a perspective view of a sheet feeder 30A according to another exemplary embodiment. As illustrated in FIG. 9, the sheet feeder 30A includes a dielectric belt 233 that is looped around a drive roller 231 and a driven roller 232. The dielectric belt 233 has a surface on or inside which a comb-shaped positive electric potential holding section PA and a comb-shaped negative electric potential holding section PB are arranged alternately in the sheet feeding direction on the surface of the dielectric belt 233. An alternating current (A/C) power supply 235A applies a positive voltage to the positive electric potential holding section PA and an alternating current (A/C) power supply 235B applies a negative voltage to the negative electric potential holding section PB. Power receiving portions 233*c* are exposed on edges in the width direction of the dielectric belt 233 on the surface of the dielectric belt 233 to receive the voltage applied from the A/C power supplies 235A and 235B through the power receiving portions 233*c* to the positive electric potential holding section PA and the negative electric potential holding section PB.

Further, in this exemplary embodiment, the drive roller 31 starts rotating after the predetermined period of time has elapsed since the dielectric belt 33 contacts the upper surface of the sheet stack S to move the lower flat portion B of the dielectric belt 33 from the sheet contact position to the sheet pick-up position and start the sheet feeding operation. However, the operation of the sheet feeder 30 of the image forming apparatus 10 is not limited thereto but the drive roller 31 can start rotating before the predetermined period of time elapses. In this case, with the force of attraction to the dielectric belt 33 generated by the electric potential patterns being generated to the second uppermost sheet S2 as well as the uppermost sheet S1, the lower flat portion B of the dielectric belt 33 is moved from the sheet contact position to the sheet pick-up position. Therefore, it is likely that the lower flat portion B at the separating position attracts not only the uppermost sheet S1 but also the second uppermost sheet S2. However, in this exemplary embodiment, the sheet pick-up operation is performed, picking up the second uppermost sheet S2 from the leading edge of the uppermost sheet S1 due to the rigidity and weight of the second uppermost sheet S2. As a result, the second uppermost sheet S2 can easily separate from the uppermost sheet S1 that is attracted to the lower flat portion B of the dielectric belt 33 at the sheet pick-up position. Accordingly, even if the sheet feeding operation is started before the predetermined period of time elapses, the sheets can be fed without causing misfeed.

The above-described exemplary embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present patent application are possible in light of the above teachings. It is therefore to be understood that, the invention may be practiced otherwise than as specifically described herein.

What is claimed is:

1. An image forming apparatus, comprising:

an image forming device to form an image on a surface of a sheet;

a sheet container to contain a sheet stack including an uppermost sheet of multiple sheets to be fed to the image forming device;

a sheet feeding unit disposed above the sheet container to feed the sheet from the sheet container to the image forming device, the sheet feeding unit including:

an endless, dielectric belt disposed facing an upper surface of the sheet stack to contact and attract the uppermost sheet to the dielectric belt and feed the sheet in a sheet feeding direction as the dielectric belt rotates; and an electric potential pattern forming unit to form an electric potential pattern on a tensioned, flat portion of the dielectric belt having multiple potential holding sections of opposite polarities disposed adjacent to each other;

a belt supporting mechanism comprising a first supporting member disposed upstream of the dielectric belt in a sheet feeding direction to rotate the dielectric belt and a second supporting member disposed downstream from the first supporting member, the first supporting member and the second supporting member supporting the dielectric belt with tension; and a moving unit to drive the first supporting member to rotate the dielectric belt to rotatably move the second supporting member about the axis of the first supporting member between a sheet attracting position, at which the flat portion of the dielectric belt contacts the upper surface of the sheet stack, and a sheet feeding position, at which the flat portion of the dielectric belt moves away from the upper surface of the sheet stack at a predetermined angle to the upper surface of the sheet stack, the rotation of the dielectric belt due to the rotation of the first supporting member creating a tension in an upper portion of the dielectric belt that is greater than a tension in a lower portion of the dielectric belt, the belt supporting mechanism, including and supporting the first supporting member and the second supporting member, rotates about the axis of the first supporting member, the moving unit rotating the first supporting member in the sheet feeding direction to rotatably move the second supporting member from the sheet attracting position to the sheet feeding position so that the flat portion of the dielectric belt moves from the sheet contact position to the sheet pick-up position, the flat portion of the dielectric belt contacting the upper surface of the sheet stack while the dielectric belt remains unrotated so as to attract the flat portion at the sheet contact position to the uppermost sheet of the sheet stack, with the uppermost sheet attracted to the flat portion of the dielectric belt by the action of an electric field generated by the electric potential pattern formed by the electric potential pattern forming unit on the flat portion of the dielectric belt.

2. The image forming apparatus according to claim 1, wherein the moving unit rotates the second supporting member about the axis of the first supporting member due to the tension in the upper portion of the dielectric belt being greater than the tension in the lower portion of the dielectric belt when the first supporting member is rotating and by using the weight of the second supporting member when the first supporting member is stopped rotating, and moves the flat portion of the dielectric belt from the sheet feeding position to the sheet attracting position.

3. The image forming apparatus according to claim 1, wherein the sheet container includes a downstream side wall to align a leading edge of the sheet stack accommodated therein by abutting the leading edge against the downstream side wall, an upper end of the downstream side wall being disposed higher than the upper surface of the sheet stack in a substantially vertical direction and lower than the uppermost sheet attracted to the flat portion at the sheet feeding position.

4. The image forming apparatus according to claim 3, wherein the downstream side wall is slanted downstream, with a top of the downstream side wall located farther downstream than a bottom of the downstream side wall in the sheet feeding direction.

5. The image forming apparatus according to claim 1, wherein, with the flat portion of the dielectric belt is located at the sheet attracting position, a downstream end of the upper surface of the sheet stack is located downstream from a downstream end of the flat portion in the sheet feeding direction.

6. The image forming apparatus according to claim 1, wherein the sheet container includes an insulating material over a possible contact area of a bottom plate of the sheet container contactable by the flat portion of the dielectric belt when no sheet stack is accommodated in the sheet container.

* * * * *